US006456200B1

(12) United States Patent
Boström et al.

(10) Patent No.: US 6,456,200 B1
(45) Date of Patent: Sep. 24, 2002

(54) DEVICE FOR INDICATING ICE FORMATION

(75) Inventors: Roland Boström, Enköping; Ragnvald Olingsberg, Järfälla, both of (SE); Bezan Nachebia; Dimitri Taits, both of St. Petersburg (RU)

(73) Assignee: Forskarpatent i Uppsala AB, Uppsala (SE)

( * ) Notice: Subject to any disclaimer, the term of this patent is extended or adjusted under 35 U.S.C. 154(b) by 0 days.

(21) Appl. No.: 08/624,615

(22) PCT Filed: Oct. 14, 1994

(86) PCT No.: PCT/SE94/00967

§ 371 (c)(1),
(2), (4) Date: Apr. 12, 1996

(87) PCT Pub. No.: WO95/10826

PCT Pub. Date: Apr. 20, 1995

(30) Foreign Application Priority Data

Oct. 15, 1993 (SE) ..... 9303411

(51) Int. Cl.[7] ..... G08B 19/02
(52) U.S. Cl. ..... 340/580; 340/581; 340/584
(58) Field of Search ..... 340/580, 581, 340/599, 584; 73/170.26; 374/112, 10; 244/134 F

(56) References Cited

U.S. PATENT DOCUMENTS 3,305,851 A 2/1967 Brandtszteter
4,210,021 A 7/1980 Vykhodtsev et al.
4,222,044 A * 9/1980 Boschung ..... 340/580
4,327,286 A * 4/1982 Thoma ..... 340/583
4,819,480 A * 4/1989 Sabin ..... 340/581
4,882,574 A * 11/1989 Khurgin ..... 340/581
4,926,163 A * 5/1990 Beebe ..... 340/584
4,996,493 A * 2/1991 Monat et al. ..... 340/580
5,418,522 A * 5/1995 Freundlieb et al. ..... 340/581

FOREIGN PATENT DOCUMENTS

SE 506 850 6/1971

* cited by examiner

*Primary Examiner*—John Tweel
(74) *Attorney, Agent, or Firm*—Frishauf, Holtz, Goodman & Chick, P.C.

(57) ABSTRACT

A device for indicating ice formation (and/or already existing ice) on a surface (6) of an object using a sensor (2) comprising a temperature difference measuring device, preferably a Peltier element (4), that has one of its contact surfaces (5) in thermal contact with the surface (6) which is exposed to ice formation. Ice formation is detected through measurement of the change in heat flow which occurs at the contact surface (5) due to the heat released in connection with ice formation, which measurement is carried out by connecting a voltage indicator to the connecting lines (11, 12) of the Peltier element. After having established that ice has formed, these wires can, if the sensor (2) is a Peltier element (4), be connected to a current source (13) for alternate heating and temperature sensoring of said contact surface (5), whereby the surface temperature will remain 0° C. as long as there is ice and considerably higher if there is no ice, which in turn is indicated by an indicator (22) that is connected to the voltage indicator.

8 Claims, 1 Drawing Sheet

DEVICE FOR INDICATING ICE FORMATION

The present invention relates to a device for indicating ice formation on, for example, a road surface, the wing of an airplane, or an electric power line using a sensor sensitive to heat released during the ice formation.

BACKGROUND OF THE INVENTION

A device for indicating ice formation can for example have the properties, disclosed in the Swiss Patent publication 506 850 for indicating a commencing of ice formation on a road surface. Here, a sensor with a Peltier element encompassed in a cap is embedded in the road surface coating at a short distance spaced below the surface. Further, at a distance apart from each other, two temperature sensors are embedded in the road surface coating and are by means of two electric wires connected to a connecting device inside the cap. The Peltier element's lower contact surface is connected to a metal plate, which plate constitutes a heat dissipating reference surface to the road surface, and its upper contact surface is connected to one of the temperature sensors by a thick conductor made of copper. The contact surfaces are connected to a current source with such a polarity that the upper contact surface is cooled, so that the copper conductor and the adjacent temperature sensor are in turned cooled. This means that when the outside temperature is decreasing and the road surface is cooled towards 0° C., this will primarily result in a freezing into ice of moisture or water onto the temperature sensor, which is cooled by the Peltier element. The formation of ice is remotely recorded as a temperature rise by the cooled temperature sensor by means of an apparatus for signal processing which is suitably placed and connected to the two temperature sensors. If the outside temperature decreases further, moisture and water on the road surface will freeze as well as on the second temperature sensor. This second sensor will also indicate a temperature rise in the apparatus for signal processing as a sign that ice formation on the road surface has occured. The distance between the temperature rises represents the time of fore-warning by means of which the indication of a present risk for ice formation is alarmed.

The device is however afflicted with several deficiencies. First, if a continuous decrease of temperature does not occur after the artificially cooled temperature sensor has indicated ice formation, a false warning occurs. Second, the device demands quite a lot of space and thus it is difficult to integrate into, for example a metal sheet. The third and most serious deficiency is however the fact that ice formation often occurs without any temperature increase in the surface of interest. For example, this is the case of slow cooling down of a wet surface. In connection with the formation of ice, an equalization of the temperature only takes place at 0° C., and thereafter the temperature decreases after all the water has frozen. Thus, in this case there will be no indication of occured ice formation.

SUMMARY OF THE INVENTION

The purpose of the invention is to produce a simplified device, that will secure the indication of ice formation almost in the very moment it occurs, and which also can be used to control how long the formed ice remains. Further, it is a purpose of the invention to provide a device which is easy to integrate with different objects where ice may form.

By endowing the device for indication of ice formation with the characteristics stated in the accompanying claims, the above stated purposes have been obtained through this invention. As the changes of temperature of the measuring surface is an unreliable indicator of the occurance of ice formation, according to what is stated above, the heat flow that always is released when ice forms will be used instead. The major quantity of heat released in connection with the formation of ice will penetrate the measuring object, and will thereby affect the heat flow that passes through the object. A commonly used method for recording heat flow is to measure the temperature difference between two closely spaced points in the direction of the heat flow. Especially useful is a Peltier element which is used in this invention.

The device according to the invention is extremely compact and easy to integrate with different surfaces. The sensor in itself may be designed as an easily integrated, small canister a few millimeters thick and containing a Peltier element or its equivalent, and which can, by a small number of conducting wires, be remotely affected, first to passively sense the released latent heat of ice formation, and thereafter to actively, by periodic, short-term heating of the measuring surface cause a melting of an extremely thin layer adjacent to the measuring surface, causing the temperature of this layer to become 0° C., followed by momentuous passive sensing indicating whether ice formation has occured or not. Note especially that the device is insensitive to the purity of the ice layer, for example contents of sand, and also for its surface nature as well as for possible vibrations etc.

BRIEF DESCRIPTION OF THE DRAWINGS

The invention is described in more detail in the following description taken in connection with the accompanying drawing which schematically shows two examples of devices in accordance with the invention.

DETAILED DESCRIPTION

Figure 1:
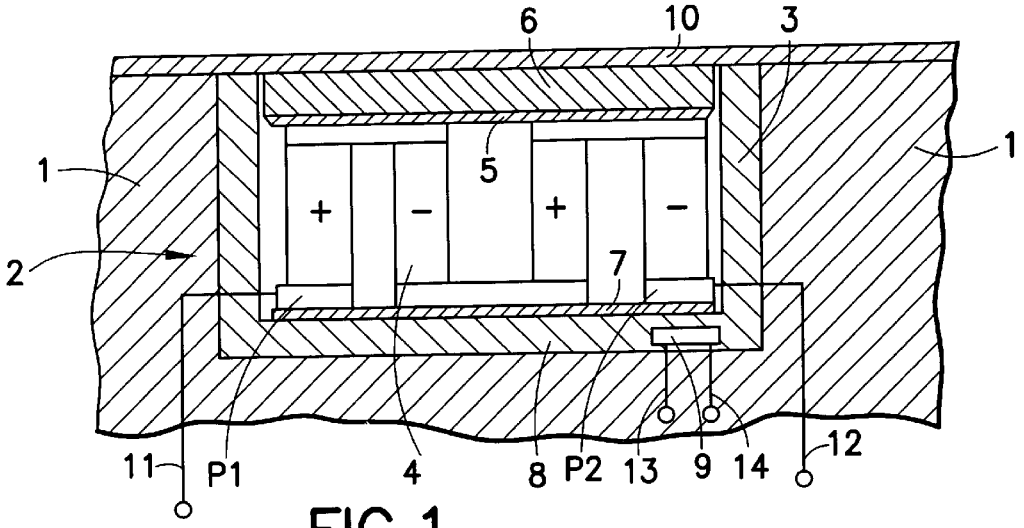
FIG. 1 is is a cross-sectional view of a sensor embedded in a road surface coating.

FIG. 1 shows a road surface coating 1, into which a sensor 2 is embedded. The sensor 2 consists of a circular cap 3 with an open top made of metal which contains a Peltier element 4 with a primary contact surface 5 in thermal contact with a circular meal plate 6, and a second contact surface 7 in thermal contact with the bottom 8 of the cap 3, into which a bottom temperature sensor 9, for example a thermistor, complete with lines 13, 14 is embedded. On top of the road surface coating 1 and the metal plate 6 of the sensor, an ice layer 10 has formed. The Peltier element 4 is preferably provided with two poles P1 and P2 and connecting lines 11, 12, to which a voltage indicator can be connected for passive (i.e., continuous) sensing of the the temperature difference between the contact surfaces, or to which a current source 33 can be connected for active generation of increasing or decreasing of the temperature of the contact surface 5 depending on the direction of the current.

Figure 2:
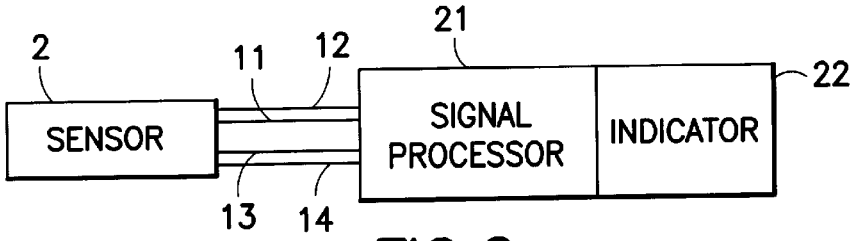
FIG. 2 is a schematic block diagram of a simple design of a device for indication of ice formation only.

In FIG. 2, the sensor 2 is shown with its lines 11, 12 and 13, 14 connected to a signal processing device 21.

Figure 3:
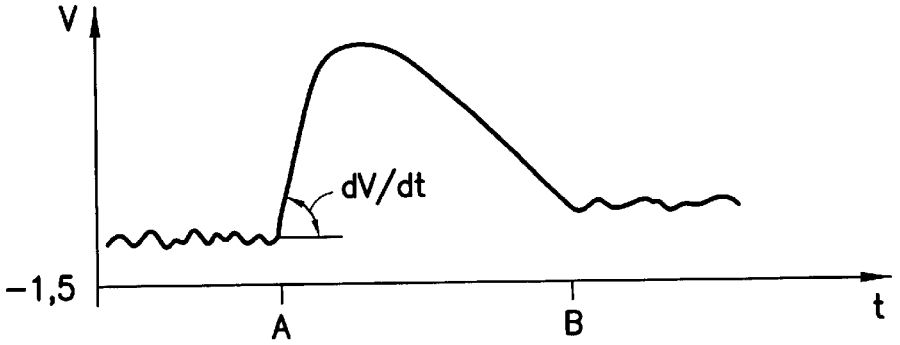
FIG. 3 is an example of a graph showing the generated electric voltage released from the sensor.

FIG. 3 shows the voltage curve characteristics, measured at the lines 11, 12. When ice formation starts at the point marked A, some of the heat released in connection with the ice formation penetrates the metal plate 6 and continuous penetrating the Peltier element 4, thus causing a change in the temperature difference between the contact surfaces 5 and 7 of the element, and by this also causing a change in the thermoelectric output voltage from the element. The thermoelectric voltage, which can be registered by an ordinary voltage indicator, is proportional to the rate of ice formation. At normal rates of ice formation, a heat affection occurs of the magnitude 0.1° C. in temperature difference across the Peltier element. By modern Peltier elements, this temperature difference equals a change in voltage of a few mV. When the formation of ice has ended, point B, the signal returns to approximately the same magnitude as at the time of the beginning of ice formation point A. The signal character at the time of the beginning of ice formation will always be distinct and the curve slope dV/dt is great and significant, and it can be used as a criteria for identifying the signal and for discriminating this particular signal from signals that depend on other disturbances in the heat flow, such as wind effects, contacts with unfamiliar objects etc. Other signal criteria include the signal reaching a certain magnitude, being of a certain duration, having the correct polarity, e g that the heat affecting the device shall be directed from outside and into the device, and, of course, that the temperature registered by the temperature sensor 9 through the lines 13, 14 is less than or equal to 0° C. If all these criteria are met, the signal will proceed to the ice formation indicator 22. Any indication of a vanishing ice layer will not be obtained by this design.

Figure 4:
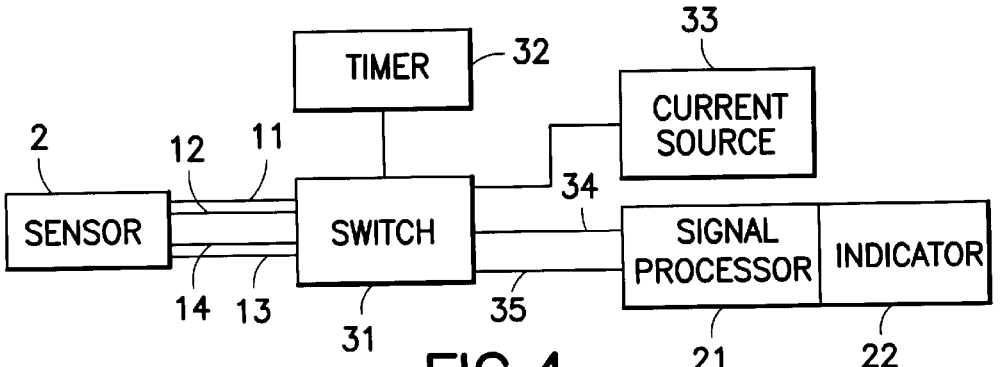
FIG. 4 is a schematic block diagram of a more complete device which will indicate ice formation as well as already existing ice.

For this purpose, the device is designed according to what is shown in FIG. 4. A switch 31 is connected between the sensor 2 and the signal processing device 21 and this switch is controlled by a timer 32. Also connected to the switch 31 is a current source 33. The signal processing device 21 has two input connections 34, 35 of which one is used before the timer is started in order to detect the commencing ice formation, and the other is used to detect the presence of ice. Further, the thermistor 9 is adjusted in order to indicate the voltage O when the temperature is equal to 0° C., thus its output voltage will be proportional to the temperature at the bottom 8 of the cap 3.

Initially, the switch 31 will be set in a position where the sensor 2 is connected to the input connection 34 of the signal processing device 21. The function of the device is described in connection with FIGS. 1–3. This position can be initiated by the temperature sensor 9, at a time when it indicates a given temperature, for example 5° C. Thus, when there appears an indication for commencing ice formation, the timer 32 will switch to a cyclical mode of the switch 31. First, the current source 33 is connected to the sensor 2, with such an effect to cause an extremely thin layer of ice adjacent to the metal plate 6 to melt. Thus, the temperature of this layer will be 0° C. Hereafter, the timer 32 connects the sensor 2 to the input connection 35 of the signal processing device 21.

In other words, the heating ends and a thermoelectric voltage will instead be fed to input connection 35 from Peltier element. This thermoelectric voltage is proportional to the temperature of the lower contact surface 7 and the bottom 8 of the cap 3, e g the temperature measured by the thermistor 9. In the signal processing device 21, the two electric voltages, the voltage from the Peltier element 4 and the voltage from the thermistor 9, are compared. Since the Peltier element and the thermistor measure the very same temperature difference, they are in concordance, and the indicator 22 thus will indicate the presence of ice. As long as the ice layer exists, the timer 32 will continue to cyclicly connect the current source 33 to the sensor 22 for a short duration and thereafter the sensor 2 to the input connection 35 of the signal processing device 21 and so on, until the ice has vanished. When the ice has vanished, the temperature of the metal plate 6 will no longer be 0° C., but considerably higher and thus the voltage from the sensor 2 will be considerably higher than the voltage from the thermistor 9, which voltage is of an unaltered magnitude. In this case, the indicator 22 will indicate that there no longer exists an ice layer on the surface.

What is claimed is:

1. A device for indicating a formation of ice on a measuring surface of an object exposed to ice formation, said device comprising:

a sensor including a Peltier element having a first contact surface in thermal contact with the measuring surface and a second contact surface in thermal contact with a reference surface within the object at a distance from the measuring surface, said sensor passively and continuously measuring a temperature difference between said first and second contact surfaces of said Peltier element; and a signal processing device connectable to said first and second contact surfaces of said Peltier element for detecting a series of changes in outputs from said sensor which occur when heat generated in connection with the formation of ice is released by the measuring surface.

2. The device according to claim 1, further comprising a timer for connecting one of a current source and said signal processing device to said first and second contact surfaces of said Peltier element at preset time intervals, said current source providing a current for melting a thin portion of a layer of ice in contact with the measuring surface to form water having a temperature of approximately 0° C. as long as an ice cover is present on the measuring surface.

3. The device according to claim 1, wherein said sensor comprises a metal cap which has an open top and which is embedded in the object exposed to ice formation, said Peltier element being placed within said metal cap with said first contact surface in thermal contact with a covering plate mounted in said open top and said second contact surface in thermal contact with a bottom said metal cap.

4. The device according to claim 1, further comprising an indicator which is activated by said signal processing device when said signal processing device detects a change in a voltage output from said sensor that has a predetermined magnitude, duration, slope and polarity at a temperature less than or equal to 0° C.

5. The device according to claim 3, wherein said sensor comprises a metal cap which has an open top and which is embedded in the object exposed to ice formation, said Peltier element being placed within said metal cap with said first contact surface in thermal contact with a covering plate mounted in said open top and said second contact surface in thermal contact with a bottom said metal cap.

6. The device according to claim 3, further comprising an indicator which is activated by said signal processing device when said signal processing device detects a change in a voltage output from said sensor that has a predetermined magnitude, duration, slope and polarity at a temperature less than or equal to 0° C.

7. The device according to claim 3, further comprising an indicator which is activated by said signal processing device when said signal processing device detects a change in a voltage output from said sensor that has a predetermined magnitude, duration, slope and polarity at a temperature less than or equal to 0° C.

8. The device according to claim 5, further comprising an indicator which is activated by said signal processing device when said signal processing device detects a change in a voltage output from said sensor that has a predetermined magnitude, duration, slope and polarity at a temperature less than or equal to 0° C.

* * * * *